US006733651B1

(12) United States Patent
Hoffacker et al.

(10) Patent No.: US 6,733,651 B1
(45) Date of Patent: May 11, 2004

(54) METHOD FOR PRODUCING A CYANIDE-FREE SOLUTION OF A GOLD COMPOUND THAT IS SUITABLE FOR GALVANIC GOLD BATHS

(75) Inventors: Gerhard Hoffacker, Aldorf (DE); Renate Franz, Gelnhausen (DE); Ramona Reitz, Nidderau (DE); Richard Walter, Alzenau (DE)

(73) Assignee: W. C. Heraeus GmbH & Co. KG (DE)

( * ) Notice: Subject to any disclaimer, the term of this patent is extended or adjusted under 35 U.S.C. 154(b) by 0 days.

(21) Appl. No.: 09/980,968

(22) PCT Filed: May 16, 2000

(86) PCT No.: PCT/EP00/04368

§ 371 (c)(1),
(2), (4) Date: Jun. 12, 2002

(87) PCT Pub. No.: WO00/73540

PCT Pub. Date: Dec. 7, 2000

(30) Foreign Application Priority Data

Jun. 1, 1999 (DE) ..... 199 24 895

(51) Int. Cl.[7] ..... C25D 3/00
(52) U.S. Cl. ..... 205/267
(58) Field of Search ..... 423/42, 43, 34, 423/27; 556/110, 116; 205/266, 267, 268; 106/1.18, 1.23, 1.26

(56) References Cited

U.S. PATENT DOCUMENTS 4,192,723 A * 3/1980 Laude et al. ..... 423/517
5,338,343 A 8/1994 Kroll et al.

FOREIGN PATENT DOCUMENTS

JP 103 171 83 12/1998

OTHER PUBLICATIONS

Article entitled "Gold Complexes of L–Cysteine and D. Penicillamine" by Donlad H. Brown, et al., Department of Pure and Applied Chemistry, University of Strathclyde, Glasgow, 1978, pp. 199–201.

Chemical Abstracts vol. 130, No. 6, Feb. 8, 1999, Columbus, Ohio, US; abstract No. 69971, Masaiki, Masashi, et al.: "Bath for displacement plating of gold" XP002147305 abstract & JP 10 317157 A (Daiwa Kasei Kenkyusho K. K., Japan) Dec. 2, 1998.

* cited by examiner

*Primary Examiner*—Steven Bos
(74) *Attorney, Agent, or Firm*—Ostrolenk, Faber, Gerb & Soffen, LLP

(57) ABSTRACT

A method for producing a cyanide-free solution of a gold compound that is suitable for gold electrodeposition baths. The method includes the steps of reacting at least one of a cysteine and a cysteinate with at least one of tetrachloroauric acid and a tetrachloroaurate in a first aqueous medium, separating a resulting precipitate from the first aqueous medium, and dissolving the precipitate in a second aqueous medium with elevation of the pH to 12.0–14.0.

7 Claims, No Drawings

METHOD FOR PRODUCING A CYANIDE-FREE SOLUTION OF A GOLD COMPOUND THAT IS SUITABLE FOR GALVANIC GOLD BATHS

PRIORITY CLAIM

This is a U.S. national stage of application Ser. No. PCT/EP00/04368, filed on May 16, 2000. Priority is claimed on that application and on the following application:

Country: Germany, Application No.: 199 24 895.8, filed Jun. 1, 1999.

BACKGROUND OF THE INVENTION

The invention concerns a method for producing a cyanide-free solution of a gold compound that is suitable for gold electrodeposition baths, a gold compound solution produced by this method, and its uses.

The use of cyanide-containing solutions of gold compounds as baths for the electrodeposition of gold on objects has long been known. Due to the high toxicity of the cyanide ions that are used and of the hydrocyanic acid that is liberated under certain conditions, the use of this well-known process is associated with considerable safety problems.

Furthermore, solutions or gold compounds for electrodeposition baths are known from the state of the art, but they have the disadvantage of decomposing after a certain amount of time. A solution of ammonium disulfitoaurate is cited as a typical example of this.

JP 10[1998]-317,183 A describes, among other things, a mercaptocarboxylic acid gold-plating bath that contains one or more of the following components: an alkali metal salt or ammonium salt of an acetylcysteine gold complex, a cysteine gold complex, a mercaptosuccinic acid gold complex, a gold chloride, and a sulfur-containing gold complex. However, these solutions also suffer from the disadvantage that they decompose after a certain amount of time.

SUMMARY AND DESCRIPTION OF THE INVENTION

This presents the problem of at least partially eliminating the disadvantages mentioned above with the aid of a new type of method, a new type of solution of gold compounds, and suitable applications. The crux of the problem is the development of a method for producing a stable, cyanide-free solution of a gold compound that is suitable for gold electrodeposition baths.

In the first step of the method of the invention, a cysteine and/or cysteinate is reacted in a first aqueous medium, especially water, with tetrachloroauric acid and/or a tetrachloroaurate. Potassium cysteinate and sodium cysteinate are examples of the cysteinate that may be used, and sodium tetrachloroaurate and potassium tetrachloroaurate are examples of suitable tetrachloroaurates.

In the second step of the method, the precipitate that forms in the first step is separated from the first aqueous medium. This separation can be effected, for example, by repeated centrifugation and decanting of the supernatant liquid.

Finally, the precipitate is dissolved in a second aqueous medium, for example, in water, by addition, for example, of a potassium hydroxide solution, which at the same time raises the pH to 12.0–14.0.

The solutions of gold compounds obtained in this way are stable for several weeks when stored with the exclusion of light and air and have outstanding properties for gold electrodeposition baths.

The following variations have been found to be practically effective and thus especially advantageous:

The separated precipitate is washed until it is free of chloride.

The molar ratio of cysteine/cysteinate to the tetrachlorogold compound is 3:1 to 10:1. Experience shows that a molar ratio of 3:1 produces the highest yields.

The reaction is advantageously carried out at a temperature of T<+30° C. since at higher temperatures the gold compound shows signs of decomposition.

In addition, it has been found to be advantageous in practice if the pH rises to 13.5 during the dissolving of the precipitate (very stable solutions), and if potassium L-cysteinate is used as the cysteinate.

The solutions of gold compounds produced by the above method have the desired properties.

Naturally, this also applies to the corresponding applications, especially those in which the solutions of gold compounds are used as precursors for the production of gold-containing heterogeneous catalysts or as gold electrodeposition baths.

The invention is illustrated by the following example.

EXAMPLE

3:1 L-cysteine/$HAuCl_4$ Solution 30.557 g (0.272 mole) of aqueous KOH solution (50%) is weighed into a beaker and diluted with 36 mL of deionized water. 32.956 g (0.272 mole) of L-cysteine is added to this solution in portions. A mildly exothermic reaction occurs. A clear, colorless solution is formed.

43.021 g (0.0906 mole) of $HAuCl_4$ solution is weighed into a second beaker (400 mL) and brought to a volume of 145 mL. Aqueous KOH solution (10%) is added to the $HAuCl_4$ solution until the pH of the solution reaches 6.1 (amount consumed=162 mL). A clear, rust-red solution is formed.

The gold chloride solution is then added in portions to the amino acid salt solution.

The pH falls steadily during this addition. The solution is clear and colorless at first. After about 20 mL of the gold chloride solution has been added, the solution becomes turbid. As more solution is added, a white suspension forms, which turns pale yellow towards the end of the addition.

Since the reaction is exothermic, the solution must be cooled throughout the addition, so that the temperature does not exceed +20° C.

The suspension is then stirred for another 1½ hours. It becomes somewhat lighter but still has a yellowish tinge. The suspension is then washed free of cholride by centrifuging.

After the suspension is chloride-free, aqueous KOH solution (50%) is added until a pH value of 13.5 is established. A golden yellow solution was obtained. Due to the slight turbidity that was still present, the solution was filtered through a cellulose filter.

A clear, golden yellow solution was then obtained, which was poured into a brown glass bottle and tightly sealed.

551.487 g of a Au-amino acid solution was obtained.

The Au content of the solution is 3.16% (Au yield: 97.7%).

The Cl content of the solution is 17 ppm.

The solution remains stable for months.

What is claimed is:

1. A method for producing a cyanide-free solution of a gold compound that is suitable for gold electrodeposition baths, comprising the steps of:

(a) reacting at least one of a cysteine and a cysteinate with at least one of tetrachloroauric acid and a tetrachloroaurate in a first aqueous medium;

(b) separating a resulting precipitate from the first aqueous medium; and (c) dissolving the precipitate in a second aqueous medium with elevation of the pH to 12.0–14.0.

2. A method in accordance with claim 1, and further comprising the step of washing the separated precipitate until it is free of chloride.

3. A method in accordance with claim 1, wherein the molar ratio of the at least one of a cysteine and a cysteinate to the tetrachlorogold compound is 3.1 to 10.1.

4. A method in accordance with claim 1, including carrying out the reacting step at a temperature of T<+30° C.

5. A method in accordance with claim 1, wherein the dissolving step includes raising the pH to 13.5.

6. A method in accordance with claim 1, wherein the reacting step includes using potassium L-cysteinate as the cysteinate.

7. A method for producing a solution of a gold compound that is suitable for gold electrodeposition gold baths as a precursor for production of gold-containing heterogeneous catalysts, the method comprising the steps of:

(a) reacting at least one of a cysteine and a cysteinate with at least one of tetrachlorauric acid and a tetrachloroaurate in a first aqueous medium;

(b) separating a resulting precipitate from the first aqueous medium; and (c) dissolving the precipitate in a second aqueous medium with elevation of the pH to 12.0–14.0.

* * * * *